US010160575B2

(12) United States Patent
Ray

(10) Patent No.: US 10,160,575 B2
(45) Date of Patent: Dec. 25, 2018

(54) BOTTLE SEALING DEVICE

(71) Applicant: James Ray, Washington, IN (US)

(72) Inventor: James Ray, Washington, IN (US)

( * ) Notice: Subject to any disclaimer, the term of this patent is extended or adjusted under 35 U.S.C. 154(b) by 100 days.

(21) Appl. No.: 15/347,438

(22) Filed: Nov. 9, 2016

(65) Prior Publication Data

US 2018/0127158 A1 May 10, 2018

(51) Int. Cl.
*B65D 41/04* (2006.01)
*B65D 1/02* (2006.01)

(52) U.S. Cl.
CPC ..... *B65D 41/0478* (2013.01); *B65D 1/0246* (2013.01); *B65D 41/0485* (2013.01)

(58) Field of Classification Search
CPC ..... B65D 41/0478; B65D 1/0246; B65D 41/0485
USPC ..... 220/254.3, 833–835; 215/237, 306
See application file for complete search history.

(56) References Cited

U.S. PATENT DOCUMENTS 613,599 A 11/1898 Pease
2,789,717 A * 4/1957 Demke ..... B65D 55/16 215/235
2,961,119 A * 11/1960 Leach ..... B65D 41/0414 215/243
3,235,117 A * 2/1966 Mason, Jr. ..... B65D 41/485 215/256
3,407,956 A * 10/1968 Linkletter ..... B65D 45/322 215/272
3,416,688 A * 12/1968 Fanning ..... A01K 97/04 215/306
4,815,628 A 3/1989 Wehnert, III
5,203,468 A * 4/1993 Hsu ..... A47G 19/2272 220/254.3
D389,409 S 1/1998 Tucker
5,853,093 A * 12/1998 Neiger ..... B65D 41/0471 215/237
5,944,207 A 8/1999 Reidenbach
D425,362 S 5/2000 Meyers et al.
6,112,452 A 9/2000 Campbell
6,390,315 B1 5/2002 Giddings et al.
7,156,253 B2 1/2007 Ziegler
D606,399 S 12/2009 Scuturio

* cited by examiner

*Primary Examiner* — James N Smalley

(57) ABSTRACT

A bottle sealing device for reversibly sealing a bottle includes a tube that is hollow. The tube is configured to insert a neck of a bottle such that the tube is reversibly couplable to the bottle with a threaded section of the bottle protruding through an upper end of the tube. A cap is pivotally coupled to the upper end of the tube. The cap also is reversibly couplable to the upper end of the tube. The cap is substantially complementary to the threaded section of the bottle. The cap is configured to reversibly and sealably couple to a lip of the bottle as the cap is reversibly coupled to the tube.

9 Claims, 3 Drawing Sheets

BOTTLE SEALING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bottle sealing devices and more particularly pertains to a new bottle sealing device for reversibly sealing a bottle.

BRIEF SUMMARY OF THE INVENTION

An embodiment of the disclosure meets the needs presented above by generally comprising a tube that is hollow. The tube is configured to insert a neck of a bottle such that the tube is reversibly couplable to the bottle with a threaded section of the bottle protruding through an upper end of the tube. A cap is pivotally coupled to the upper end of the tube. The cap also is reversibly couplable to the upper end of the tube. The cap is substantially complementary to the threaded section of the bottle. The cap is configured to reversibly and sealably couple to a lip of the bottle as the cap is reversibly coupled to the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
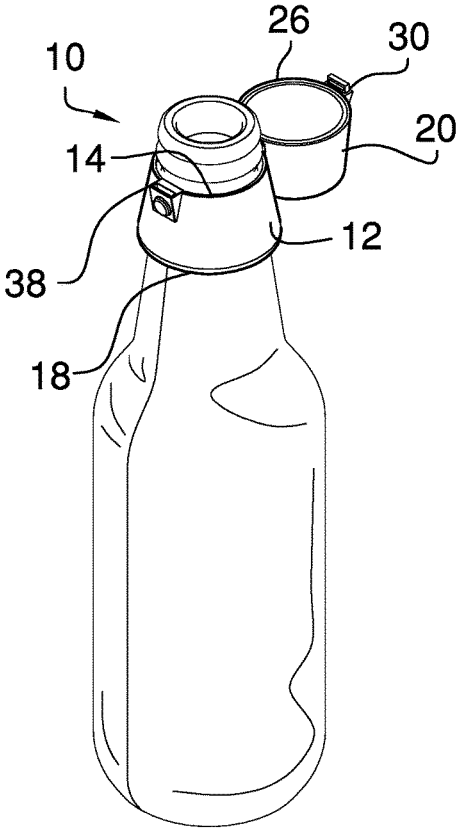
FIG. 1 is an isometric perspective view of a bottle sealing device according to an embodiment of the disclosure.
Figure 2:
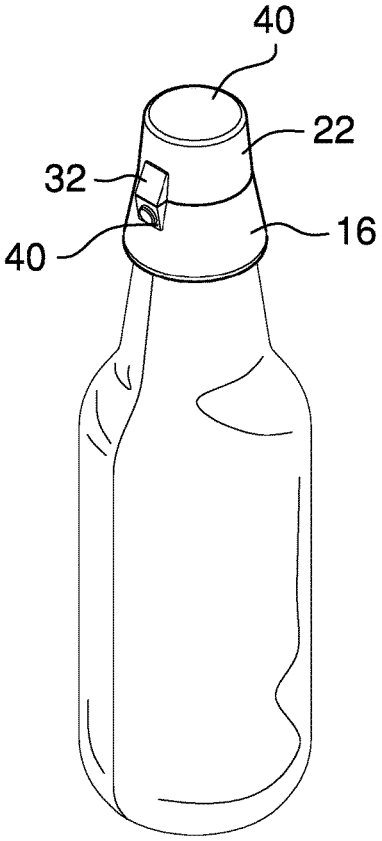
FIG. 2 is an isometric perspective view of an embodiment of the disclosure.
Figure 3:
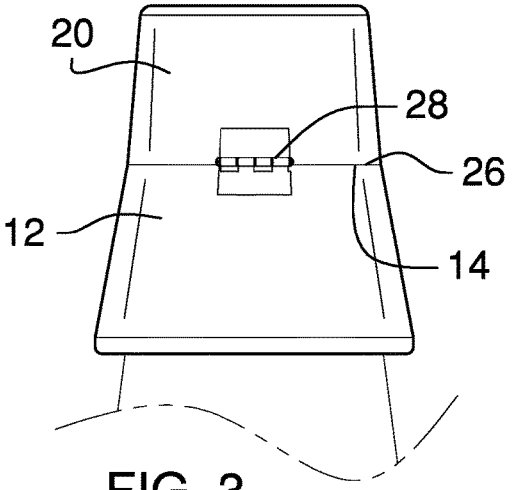
FIG. 3 is a back view of an embodiment of the disclosure.
Figure 4:
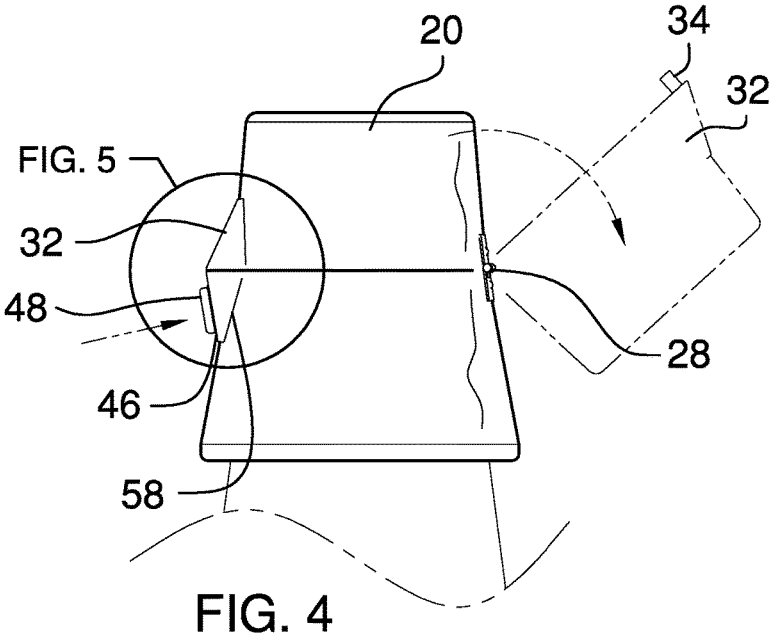
FIG. 4 is a side view of an embodiment of the disclosure.
Figure 5:
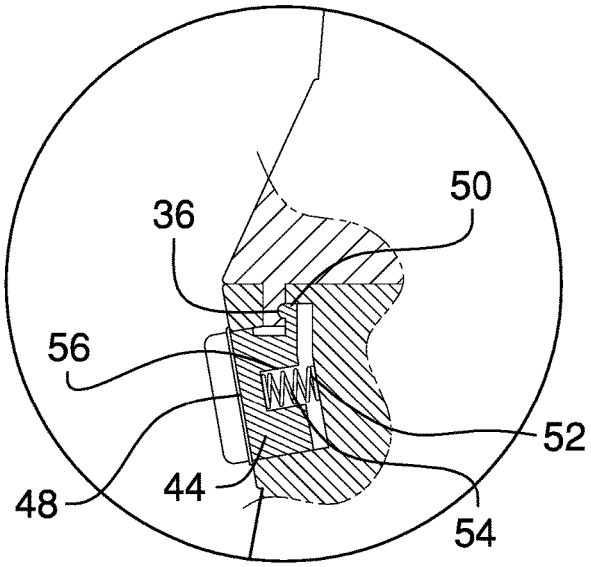
FIG. 5 is a detail view of an embodiment of the disclosure.
Figure 6:
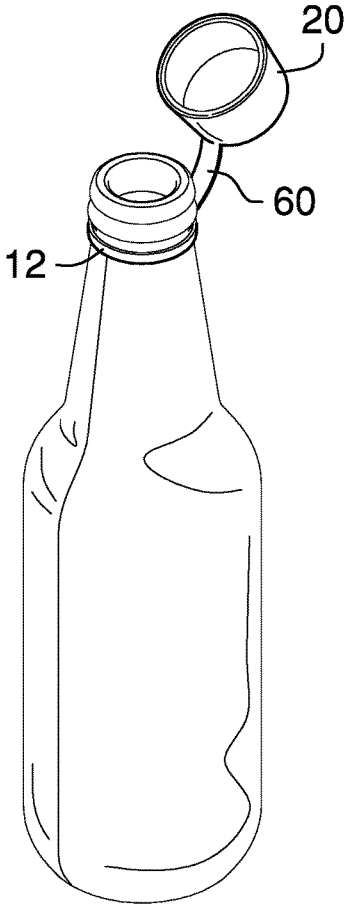
FIG. 6 is an isometric perspective view of an embodiment of the disclosure.

With reference now to the drawings, and in particular to FIGS. 1 through 6 thereof, a new bottle sealing device embodying the principles and concepts of an embodiment of the disclosure and generally designated by the reference numeral 10 will be described.

As best illustrated in FIGS. 1 through 6, the bottle sealing device 10 generally comprises a tube 12. The tube 12 is hollow and is configured to insert a neck of a bottle. The tube 12 is configured to insert the neck of the bottle such that the tube 12 is reversibly couplable to the bottle, with a threaded section of the bottle protruding through an upper end 14 of the tube 12. The tube 12 comprises an annular sidewall 16 that extends from the upper end 14 to a lower end 18 of the tube 12. In one embodiment, the lower end 18 is dimensionally larger than the upper end 14, such that the tube 12 is tapered.

A cap 20 is pivotally coupled to the upper end 14 of the tube 12. The cap 20 also is reversibly couplable to the upper end 14 of the tube 12. The cap 20 is substantially complementary to the threaded section of the bottle that protrudes through the upper end 14 of the tube 12. The cap 20 is configured to reversibly and sealably couple to a lip of the bottle as the cap 20 is reversibly coupled to the tube 12. The cap 20 comprises an annular wall 22 that extends from a top 24 to a bottom 26. The top 24 is closed and the bottom 26 is open. In one embodiment, the bottom 26 is complementary to the upper end 14 of the tube 12. In another embodiment, the bottom 26 is dimensionally larger than the top 24 such that the cap 20 is tapered.

In one embodiment, a hinge 28 is coupled to and extends between the cap 20 and the tube 12, such that the cap 20 and the tube 12 are hingedly coupled. In another embodiment, the hinge 28 is spring-loaded such that the cap 20 is biased to an open configuration.

A first coupler 30 is coupled to the cap 20. The first coupler 30 is diametrically opposed to the hinge 28. In one embodiment, the first coupler 30 comprises a first protrusion 32 that is coupled to and extends radially from the cap 20. A tab 34 is coupled to and extends substantially perpendicularly from the first protrusion 32. A groove 36 is positioned in the tab 34 distal from the first protrusion 32.

A second coupler 38 is coupled to the tube 12. The second coupler 38 is complementary to the first coupler 30. The second coupler 38 is positioned on the tube 12 such that the second coupler 38 is positioned to couple to the first coupler 30 to couple the tube 12 to the cap 20. In one embodiment, the second coupler 38 comprises a second protrusion 40 that is coupled to and extends radially from the tube 12. The second protrusion 40 is complementary to the first protrusion 32. A slot 42 is positioned in the second protrusion 40. The slot 42 is complementary to the tab 34. The slot 42 is positioned in the second protrusion 40 and is positioned to insert the tab 34 as the threaded section of the bottle that protrudes through the upper end 14 of the tube 12 is inserted into the cap 20.

A channel 44 is positioned in a front face 46 of the second protrusion 40. A button 48 is coupled to the second protrusion 40 and is positioned within the channel 44. An extrusion 50 is coupled to the button 48. The extrusion 50 is complementary to the groove 36. The extrusion 50 is positioned on the button 48 and is positioned to couple to the groove 36 as the tab 34 is inserted into the slot 42, whereby the cap 20 is coupled to the tube 12. The button 48 is positioned in the channel 44 and is configured to be depressed by a user to decouple the extrusion 50 from the groove 36, whereby the cap 20 is decoupled from the tube 12.

An actuator 52 is coupled to the tube 12. The actuator 52 is operationally coupled to the second coupler 38. The actuator 52 is positioned on the tube 12 and is positioned to motivate the second coupler 38 to couple to the first coupler 30, such that the cap 20 is coupled to the tube 12. In one embodiment, the actuator 52 comprises a spring 54. The spring 54 is positioned in a slit 56. The slit 56 is positioned in a back face 58 of the button 48.

In another embodiment of the invention. The device 10 comprises a strap 60 that is coupled to and extends between the cap 20 and the tube 12. In this embodiment, the tube 12 is deformable and the cap 20 is frictionally couplable to the lip of the bottle. The tube 12 is configured to insert the neck of the bottle such that the tube 12 is reversibly coupled to the bottle with the threaded section of the bottle protruding through the upper end 14 of the tube 12. The strap 60 is positioned between the cap 20 and the tube 12 such that the cap 20 is configured to reversibly and sealably couple to the lip of the bottle.

The present invention anticipates a power module, which is coupled to the tube 12, and a light emitting diode that is coupled to and positioned in the button 48. The light emitting diode is operationally coupled to the power module, such that the button 48 is illuminated.

In use, the tube 12 is configured to insert the neck of the bottle. The tube 12 is reversibly couplable to the bottle, with the threaded section of the bottle protruding through the upper end 14 of the tube 12. The hinge 28 is coupled to the cap 20 and the tube 12 such that the cap 20 is biased to an open configuration. The extrusion 50 is positioned on the button 48 and is positioned to couple to the groove 36 as the tab 34 is inserted into the slot 42. This couples the cap 20 to the tube 12, and the cap 20 is sealably coupled to the lip of the bottle. The button 48 is positioned in the channel 44 and is configured to be depressed by a user to decouple the extrusion 50 from the groove 36. The cap 20 is decoupled from the tube 12 and the hinge 28 biases the cap 20 to the open configuration. The contents of the bottle are positioned to be drunk by a user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bottle sealing device comprising:

a tube, said tube being hollow such that said tube is configured for insertion of a neck of a bottle;

a cap pivotally coupled to an upper end of said tube, said cap being reversibly couplable to said upper end of said tube, said cap being substantially complementary to a threaded section of the bottle protruding through said upper end of said tube;

wherein said tube is configured for insertion of the neck of the bottle such that said tube is reversibly couplable to the bottle with the threaded section of the bottle protruding through said upper end of said tube such that said cap is configured to reversibly and sealably couple to a lip of the bottle as said cap is reversibly coupled to said tube;

a hinge coupled to and extending between said cap and said tube;

a first coupler coupled to said cap, said first coupler being diametrically opposed to said hinge;

a second coupler coupled to said tube, said second coupler being complementary to said first coupler;

an actuator coupled to said tube, said actuator being operationally coupled to said second coupler; and wherein said second coupler is positioned on said tube such that said second coupler is positioned to couple to said first coupler to couple said tube to said cap, wherein said actuator is positioned on said tube such that said actuator is positioned to motivate said second coupler to couple to said first coupler such that said cap is coupled to said tube.

2. The device of claim 1, further including said tube comprising an annular sidewall extending from said upper end to a lower end of said tube.

3. The device of claim 2, further including said lower end being dimensionally larger than said upper end, such that said tube is tapered.

4. The device of claim 1, further including said cap comprising an annular wall extending from a top to a bottom, said top being closed, said bottom being open.

5. The device of claim 4, further including said bottom being complementary to said upper end of said tube.

6. The device of claim 4, further including said bottom being dimensionally larger than said top such that said cap is tapered.

7. The device of claim 1, further including said hinge being spring-loaded such that said cap is biased to an open configuration.

8. The device of claim 1, further comprising said first coupler comprising:

a first protrusion coupled to and extending radially from said cap, a tab coupled to and extending substantially perpendicularly from said first protrusion, and a groove positioned in said tab distal from said first protrusion;

said second coupler comprising:

a second protrusion coupled to and extending radially from said tube, said second protrusion being complementary to said first protrusion, a slot positioned in said second protrusion, said slot being complementary to said tab, wherein said slot is positioned in said second protrusion such that said slot is positioned for insertion of said tab as the threaded section of the bottle protruding through said upper end of said tube is inserted into said cap, a channel positioned in a front face of said second protrusion, a button coupled to said second protrusion and positioned within said channel, a slit, said slit being positioned in a back face of said button, and an extrusion coupled to said button, said extrusion being complementary to said groove, wherein said extrusion is positioned on said button such that said extrusion is positioned for coupling to said groove as said tab is inserted into said slot such that said cap is coupled to said tube, and wherein said button is positioned in said channel such that said button is configured for depression by a user to decouple said extrusion from said groove, such that said cap is decoupled from said tube; and said actuator comprising a spring, said spring being positioned in said slit.

9. A bottle sealing device comprising:

a tube, said tube being hollow such that said tube is configured for insertion of a neck of a bottle, wherein said tube is configured for insertion of the neck of the bottle such that said tube is reversibly couplable to the bottle with a threaded section of the bottle protruding through an upper end of said tube, said tube comprising an annular sidewall extending from said upper end to a lower end of said tube, said lower end being dimensionally larger than said upper end, such that said tube is tapered;

a cap pivotally coupled to said upper end of said tube, said cap being reversibly couplable to said upper end of said tube, said cap being substantially complementary to the threaded section of the bottle protruding through said upper end of said tube such that said cap is configured to reversibly and sealably couple to a lip of the bottle as said cap is reversibly coupled to said tube, said cap comprising an annular wall extending from a top to a bottom, said top being closed, said bottom being open, said bottom being complementary to said upper end of said tube, said bottom being dimensionally larger than said top such that said cap is tapered;

a hinge coupled to and extending between said cap and said tube, said hinge being spring-loaded such that said cap is biased to an open configuration;

a first coupler coupled to said cap, said first coupler being diametrically opposed to said hinge, said first coupler comprising:

a first protrusion coupled to and extending radially from said cap, a tab coupled to and extending substantially perpendicularly from said first protrusion, and a groove positioned in said tab distal from said first protrusion;

a second coupler coupled to said tube, said second coupler being complementary to said first coupler, wherein said second coupler is positioned on said tube such that said second coupler is positioned to couple to said first coupler to couple said tube to said cap, said second coupler comprising:

a second protrusion coupled to and extending radially from said tube, said second protrusion being complementary to said first protrusion, a slot positioned in said second protrusion, said slot being complementary to said tab, wherein said slot is positioned in said second protrusion such that said slot is positioned for insertion of said tab as the threaded section of the bottle protruding through said upper end of said tube is inserted into said cap, a channel positioned in a front face of said second protrusion, a button coupled to said second protrusion and positioned within said channel, and an extrusion coupled to said button, said extrusion being complementary to said groove, wherein said extrusion is positioned on said button such that said extrusion is positioned for coupling to said groove as said tab is inserted into said slot such that said cap is coupled to said tube, and wherein said button is positioned in said channel such that said button is configured for depression by a user to decouple said extrusion from said groove, such that said cap is decoupled from said tube;

an actuator coupled to said tube, said actuator being operationally coupled to said second coupler, wherein said actuator is positioned on said tube such that said actuator is positioned to motivate said second coupler to couple to said first coupler such that said cap is coupled to said tube, said actuator comprising a spring, said spring being positioned in a slit, said slit being positioned in a back face of said button; and wherein said tube is configured for insertion of the neck of the bottle such that said tube is reversibly couplable to the bottle with a threaded section of the bottle protruding through an upper end of said tube, wherein said hinge is coupled to said cap and said tube such that said cap such that said cap is biased to an open configuration, wherein said extrusion is positioned on said button such that said extrusion is positioned for coupling to said groove as said tab is inserted into said slot such that said cap is coupled to said tube, such that said cap is sealably coupled to the lip of the bottle, and wherein said button is positioned in said channel such that said button is configured for depression by a user to decouple said extrusion from said groove, such that said cap is decoupled from said tube such that said hinge biases said cap to the open configuration wherein contents of the bottle are positioned for drinking by a user.

* * * * *